US005377391A

United States Patent [19]

Foster

[11] Patent Number: 5,377,391

[45] Date of Patent: Jan. 3, 1995

[54] BED COVERING RETAINING DEVICE

[76] Inventor: Wilbur A. Foster, Ste. 650, 3300 Bee Caves Rd., Austin, Tex. 78746-6663

[21] Appl. No.: 962,659

[22] Filed: Oct. 19, 1992

[51] Int. Cl.[6] ..... A47C 21/00

[52] U.S. Cl. ..... 24/72.5; 24/301; 5/496

[58] Field of Search ..... 24/72.5, 462, 490, 498, 24/300, 301, 302; 5/496, 494, 498

[56] References Cited

U.S. PATENT DOCUMENTS

| | | | |
|---|---|---|---|
| 829,118 | 8/1906 | Meek | 24/72.5 |
| 1,782,057 | 11/1930 | Bollinger | 24/301 |
| 1,804,308 | 5/1931 | Bollinger | 24/301 |
| 2,024,050 | 8/1934 | May | 24/72.5 |
| 3,092,848 | 9/1960 | Gronvold | 5/320 |
| 3,727,272 | 4/1973 | Rhodes | 24/300 |
| 4,115,906 | 9/1978 | Lavine et al. | 24/301 |
| 4,698,880 | 10/1987 | Hamm | 24/72.5 |
| 4,891,856 | 1/1990 | Thornhill | 5/496 |
| 5,014,399 | 5/1991 | Grisel | 24/490 |
| 5,016,306 | 5/1991 | Grivna et al. | 5/496 |
| 5,072,470 | 12/1991 | Lysiak | 5/496 |
| 5,111,554 | 5/1992 | Sweers | 24/301 |

*Primary Examiner*—Victor N. Sakran
*Attorney, Agent, or Firm*—Walter C. Farley

[57] ABSTRACT

A retainer for a mattress cover such as a sheet has a central band made of a stiff, smooth material and elastic straps attached to opposite ends of the band. Openable and lockable fasteners are attached to the ends of the straps, each fastener having a pair of jaws. One end of a short length of cord is attached to the fastener, the other end being free. In use, the band extends under the mattress and the fasteners are clamped to opposite sides of the cover with the cord inside a bight or fold of the cover to provide an enlargement which can be securely gripped by the fastener.

14 Claims, 2 Drawing Sheets

BED COVERING RETAINING DEVICE

FIELD OF THE INVENTION

This invention relates to an improved device for holding a sheet or other bed covering securely in place on a mattress.

BACKGROUND OF THE INVENTION

When a sheet or similar covering is placed on a mattress, it tends to slide because mattresses are commonly finished with a rather slippery surface. A flat sheet, mattress cover or even a fitted sheet slides because of the low friction between it and the mattress and, when a person gets into the bed, the sheet is likely to be displaced.

Various solutions have been proposed to solve this problem, including straps which extend beneath the mattress and engage marginal portions of the sheet. In principle, this is a sound solution, but its implementation has given rise to some problems which have not been adequately solved, particularly in the attachment between the ends of the strap and the sheet. It has been proposed, for example, to use a strap or belt which has snap members or similar fasteners at the ends and to then permanently attach mating snap members to the sheet itself. While this would seem to be workable, it has the disadvantages of requiring the purchaser to go through the process of attaching the snap fasteners to the sheets or else acquiring special sheets to accompany the strap, neither of which is a satisfactory solution.

Other devices of this type have used more universal attachment means not requiring special sheets, but the attachment devices have involved grippers which, in order to engage the sheet securely enough, tend to tear the fabric of the sheet, thereby shortening its useful life.

In addition, those strap devices proposed in the past have had limitations on their effectiveness and simplicity of installation because of the structural nature and the materials employed.

SUMMARY OF THE INVENTION

Accordingly, an object of the present invention is to provide a retaining belt or strap for holding a cover on a bed mattress which is simple to install and which has an improved arrangement for engaging and holding the cover at both ends of the strap.

A further object is to provide a cover-retaining strap which is stiff throughout a major part of its length to facilitate installation and to improve its cover-retaining properties.

Briefly described, the invention comprises an elongated device for holding a cover on a bed mattress or the like comprising an elongated band of stiff, substantially inelastic material having smooth surfaces and having a length less than a dimension of a mattress with which the device is to be used and first and second openable and closeable fasteners, each fastener having a pair of jaws openable to receive fabric and lockable in the closed position. First and second elastic straps at opposite ends of the band interconnect the fasteners and opposite ends of the band, each of the elastic straps being fixedly attached at one end to an end of the band and at the other end to one of the first and second fasteners. First and second lengths of cord are fixedly attached at one end to one end of said device, the other ends of the lengths of cord being unattached until the device is used. In use, the band is inserted under a mattress, the cords are placed in folds adjacent marginal portions of the cover on opposite sides of the mattress and the jaws of the fasteners are closed and locked over the folds and cords together, with each fold enclosing one cord, so that the cover is securely held thereby.

BRIEF DESCRIPTION OF THE DRAWINGS

In order to impart full understanding of the manner in which these and other objects are attained in accordance with the invention, particularly advantageous embodiments thereof will be described with reference to the accompanying drawings, which form a part of this disclosure, and wherein.

DESCRIPTION OF THE PREFERRED EMBODIMENT

In the following description, the use of the device of the present invention will be discussed in connection with holding a sheet on a mattress, but it will be recognized that the nature of the cover being held on the mattress is not important and that the it is contemplated that the device can be used to hold a mattress cover, blanket or any other cover with which it may be useful.

Figure 1:
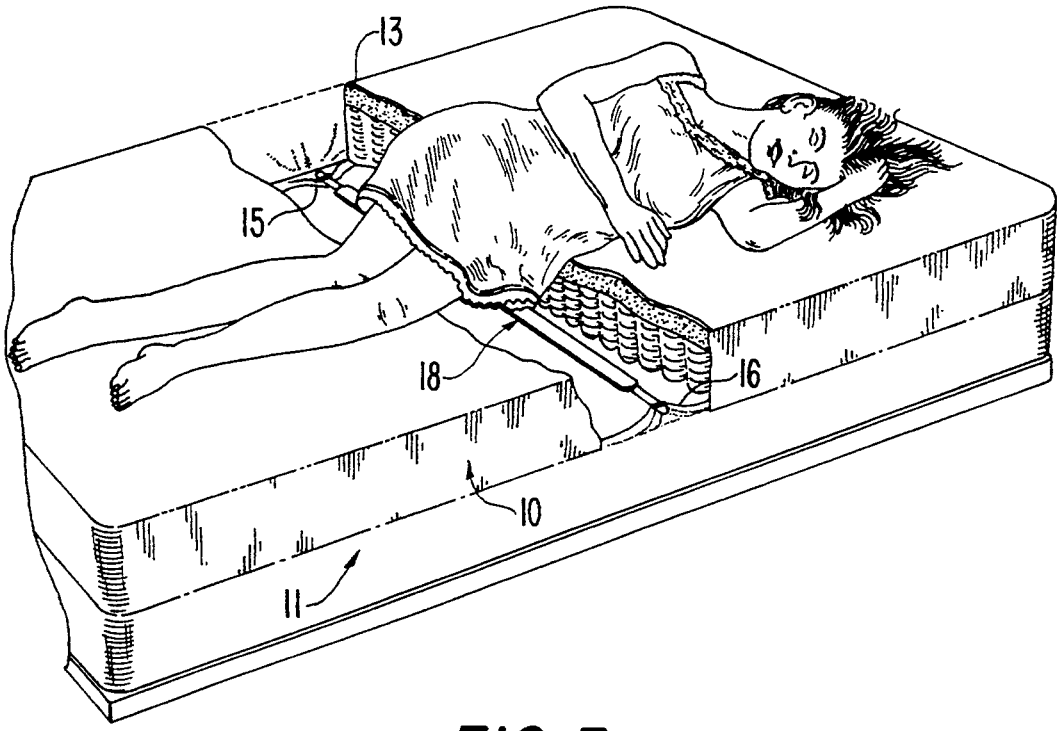
FIG. 1 is a partially cutaway perspective view of a typical mattress showing a device in accordance with the invention used therewith.

FIG. 1 shows a typical mattress indicated generally at 10 resting on box springs 11, the mattress being covered with a bottom sheet 13. Marginal portions 15 and 16 of the sheet extend around opposite sides of the mattress and under the edges of the mattress between the mattress and the box springs and, in the absence of other assistance, are held under the mattress simply by whatever friction there might be between the sheet and the mattress and box springs. Because that friction is often low, the sheet can be released partly or entirely, allowing the part of the sheet on which one lies to become slack.

To retain the sheet, a device in accordance with the invention, indicated generally at 18, extends under the mattress and is attached to marginal portions 15 and 16 of the sheet, holding it in place. Device 18 is shown extending transversely across the bed which is clearly one advantageous way in which it can be used. However, the device can also be used extending lengthwise, if desired, either alone or in conjunction with one extending across the mattress as shown; or two such devices can be used crossing each other, each extending from one corner of the bed to a diagonally opposite corner. In each case the structure is the same; only the length dimensions of portions of the device differ.

Figure 2:
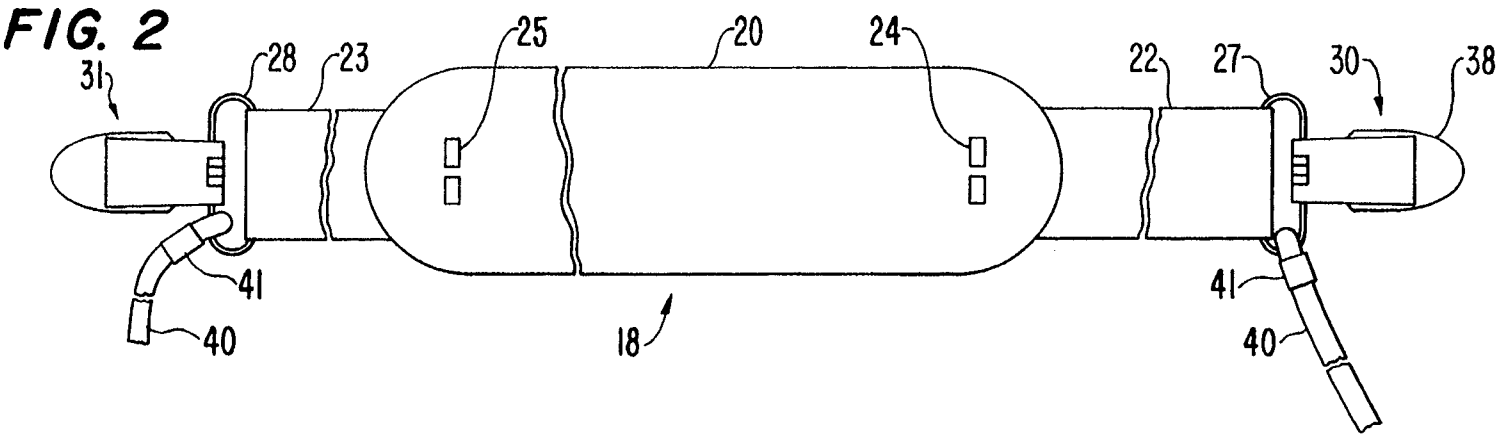
FIG. 2 is a foreshortened plan view of a device in accordance with the invention.

Device 18 is shown in more detail in FIG. 2 and includes a central band 20 which is made of a low-friction plastic such as a medium density polyethylene, although other materials could be used. It is important for band 20 to be bendable but rather stiff so that it can be pushed between the mattress and box springs from one side of the bed. For use with a standard double bed, band 20 is typically about 32.5 inches long, about 1.5 inches wide and about ⅛ to 3/16 inches thick. First and second elastic straps 22 and 23 are fixedly attached to opposite ends of band 20 by attachment means such as staples 24 and 25.

Each strap 22, 23 in the embodiment shown is made of a length of elastic about 1 inch wide and about 12 inches long, doubled over to form a bight at the end farthest from the band. The elastic is of a type commonly available at stores dealing in fabrics and other materials for making clothing and the like. In the present embodiment, the elastic, doubled over to form a strap about 5 inches long when unstretched, can be elastically elongated to a maximum length of about 11 inches. Both of the cut ends of the elastic are preferably folded over adjacent the band to provide extra thickness for the staple, and each staple 24, 25 is a heavy-duty, wide staple which forms a substantially permanent attachment between the strap and band.

Figure 3:
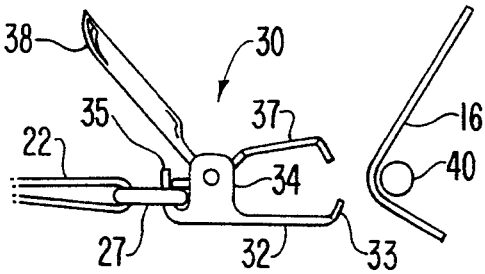
FIG. 3 is a side elevation of a fastener of a type usable with the invention.
Figure 4:
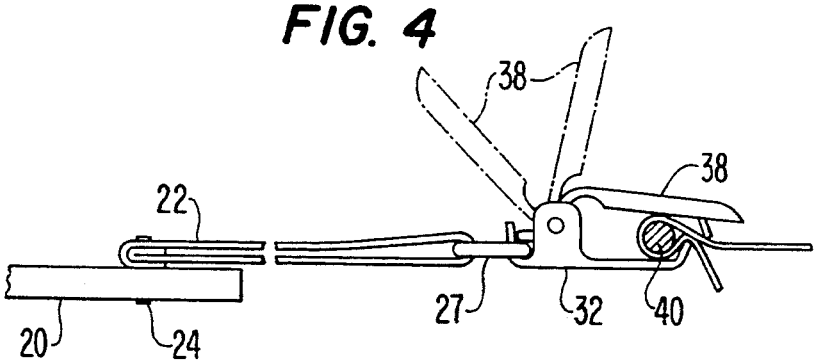
FIGS. 4, 5, 6 and 7 are illustrations of the sequence of steps for installation of the device of FIGS. 1 and 2.

When the strap is folded over as described above, the bight is passed through a wire loop 27 or 28 of one of two clips 30 and 31 which are provided to engage and grip the cover. The clips themselves, one of which is shown in more detail in FIGS. 3 and 4, are conventional in nature and are similar to clips sometimes used on men's suspenders, each having a main body 32 forming a lower jaw 33, side trunions 34 and a bracket 35 for holding loop 27 about which elastic strap 22 passes. An upper jaw 37 has rear tangs which extend through an opening in the rear of main body 32 and side members extending laterally between bracket 35 and side trunions 34, allowing the upper jaw to move relative to the lower jaw and keeping loop 27 from escaping. A movable blade 38 is pivotally mounted in trunions 34 and pivots between an open position shown in FIG. 3 and a closed position shown in FIG. 4. In the closed position, the jaws are locked in an "overbite" position capable of engaging fabric therebetween. The clip is opened by lifting blade 38, allowing the jaws to open.

Of particular importance is the provision of a length of cord 40 at each clip. Cord 40 is preferably a Nylon compliant cord about 5" or 6 inches long and about 3/16 inch to ¼ inch in diameter. One end of the cord is doubled upon itself through a side of wire loop 27 or 28 and fastened in that position by a retaining band 41 of material such as heat-shrinkable tubing or a hog ring, the other end being free when not in use. To realize the need for cord 40, one must recognize the fact that a clip such as clip 30 or 31 used alone to grab an edge of the cover would have some difficulty holding on to the cover or, if a clip of sufficient clamping strength were used, it would have a tendency to tear the sheet when placed under tension which is the normal use for the device of the present invention. The jaws of such clips commonly are formed with serrations at the distal edges of the jaws which can either be so smooth as to be essentially ineffective or so pointed as to be damaging.

The use of the cord overcomes this problem. By placing the cord inside a simple fold or bight of the edge of the sheet and then closing the jaws over the bight so that the cord is inside the jaws, as illustrated in FIG. 4, a relatively large lump is formed inside the jaws which is substantially impossible to remove from the jaws by simply pulling on the cover, and yet the cover itself is not gripped directly by the jaws in such a way that tearing forces are applied thereto. The cover is thus firmly and securely held without damaging the cover or significantly shortening its useful life. Attaching the cord to the clip in the manner shown makes the cord available when needed and assures that it will not be lost between uses.

As thus described, the total length of a retaining device in accordance with the invention, made for a standard double bed, is about 43 inches in its relaxed condition and is stretchable to a total length of about 55 inches from the end of one clip to the end of the other. It is contemplated that the device of the invention would be shipped in a box with the band 20 coiled into a circle of about 6 inches or so in diameter.

Figure 5:
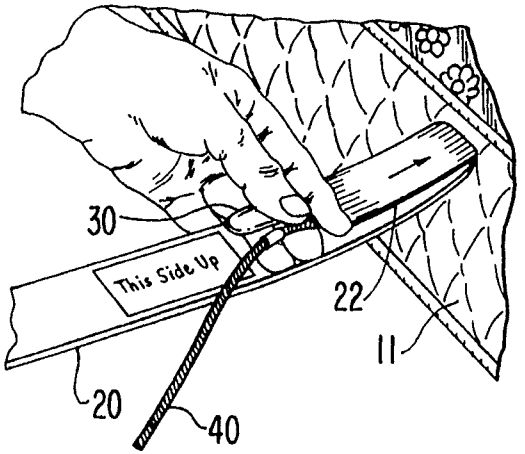

To install a device in accordance with the invention, one would remove the device from the box and straighten it by bending it in the opposite direction from its original coiling. Because of the rather stiff nature of the band 20, it tends to remain coiled after having been in that condition for some time, but can be straightened in a few minutes. The band is preferably labeled on one side to indicate which side should be uppermost for installation, that side being as shown in FIG. 2 with the lower jaws of the clips facing up. With the clips closed, the strap 22 and clip 30 at one end of the device is folded back over the band 20 as shown in FIG. 5 and the end of the band is inserted between the mattress and box springs 11 about half-way along the length of the mattress, leaving an inch or so visible at the near end. In the case of a platform bed which has no box spring unit, the band is inserted between the mattress and the supporting slats.

Figure 6:
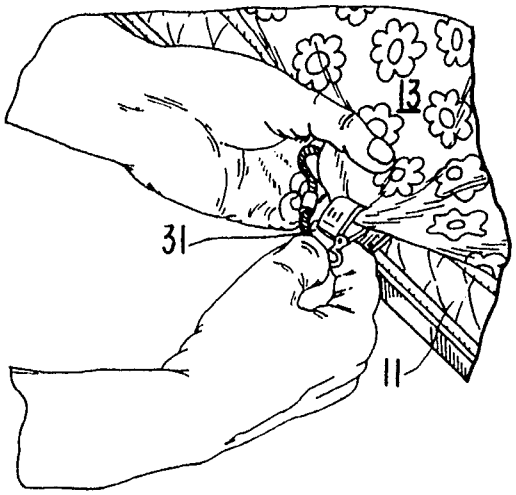
Figure 7:
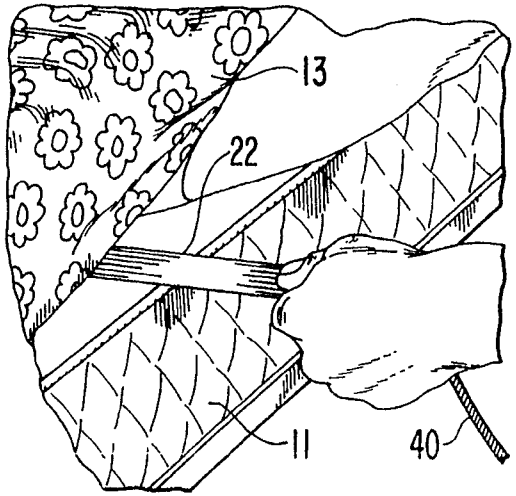

The clip is then attached to the closest side of the sheet or other cover as illustrated in FIGS. 3, 4 and 6 by opening the clip 31, placing an inch or so of cord 40 inside the edge of the sheet, rolling the edge of the sheet around the cord, placing the sheet and cord inside the jaws of the clip and closing the clip. The near end is then grasped and pushed until it is as far under the mattress as one can reach, stretching strap 23. On the other side of the bed, the strap is grasped and pulled through (FIG. 7) and clip 30 is then attached to the other side of the cover in the same manner as clip 31 was attached, again placing cord 40 inside the edge of the sheet. This completes the installation. It will be noted that the retainer device need not be removed when changing sheets. It is only necessary to open the clips, remove the old sheet, replace it with the new and re-attach the clips as described above.

For use with a small, narrow mattress such as a crib mattress or the like which is very light and easily handled compared with a conventional double, queen or king size mattress, it may not be necessary to make the center part of the band with the stiff material as described above. Rather, the entire band can be made flexible or even elastic because the mattress is commonly covered with a sheet by simply lifting the entire mattress and turning it over to attach the device of the invention. Thus, having the ability to push the band between mattresses or under a mattress is not so important. However, the cords and clips at the end are extremely advantageous.

While certain advantageous embodiments have been chosen to illustrate the invention, it will be understood by those skilled in the art that various changes and modifications can be made therein without departing from the scope of the invention as defined in the appended claims.

What is claimed is:

1. An elongated device for holding a cover on a bed comprising the combination of an elongated band of stiff, substantially inelastic material having smooth surfaces and having a length less than a dimension of a mattress with which the band is to be used;

first and second openable and closeable fasteners, each said fastener having a pair of jaws openable to receive cover fabric and lockable in the closed position;

first and second elastic straps at opposite ends of said band, each of said elastic straps being substantially permanently attached at one end to an end of said band and at the other end to one of said first and second fasteners; and first and second lengths of cord each fixedly attached at one end to one end of said device, the other ends of said lengths of cord being unattached until the device is used, whereupon said band is inserted under the mattress, said cords are placed in folds adjacent marginal portions of the cover to be held onto the mattress on opposite sides of said mattress and said jaws of said fasteners are closed and locked over said folds and cords together with each fold enclosing one cord so that said cover is securely held thereby.

2. A device according to claim 1 wherein the length of each said elastic strap is less than one-quarter the length of said band.

3. A device according to claim 2 wherein each said elastic strap is stretchable to about twice its unstretched length.

4. A device according to claim 3 wherein each said fastener includes a wire loop attached to one of said jaws and wherein one of said straps passes through one of said loops.

5. A device according to claim 4 wherein each said strap comprises a length of elastic material folded upon itself to form a double thickness strap, the fold of said strap extending through said fastener loop and ends of said elastic material being attached to said band.

6. A device according to claim 5 wherein said cord is attached at one end to said fastener loop.

7. A device according to claim 6 wherein said band is made of a medium density polyethylene.

8. A device according to claim 3 wherein each said strap comprises a length of elastic material folded upon itself to form a double thickness strap, the fold of said strap extending through said loop and ends of said elastic material being attached to said band.

9. A device according to claim 3 wherein said cord is attached at one end to said loop.

10. A device according to claim 3 wherein said band is made of a medium density polyethylene.

11. A device according to claim 1 wherein said band is made of a medium density polyethylene.

12. A device according to claim 1 wherein the length of said elongated band is selected to accomodate the width of the mattress with which it is used, the lengths of said elastic straps remaining unchanged.

13. An elongated device for holding a cover on a narrow mattress such as a crib mattress comprising the combination of an elongated band of material having a length less than the width dimension of a mattress with which the band is to be used, at least end portions of said band being elastic;

first and second openable and closeable fasteners, each said fastener having a pair of jaws openable to receive cover fabric and lockable in the closed position, each of said fasteners being substantially permanently attached to opposite ends of said band;

first and second lengths of compliant cord each permanently fixedly attached at one end to one end of said device, the other ends of said lengths of cord being unattached until the device is used, whereupon said band is positioned under the mattress, said cords are placed in folds adjacent marginal portions of the cover to be held onto the mattress on opposite sides of said mattress and said jaws of said fasteners are closed and locked over said folds and cords together with each fold enclosing one cord so that said cover is securely held thereby.

14. An elongated device for holding a fabric cover on a mattress comprising the combination of an elongated band of material having a predetermined length;

first and second openable and closeable fasteners, each said fastener having a pair of jaws openable to receive cover fabric and lockable in the closed position, each of said fasteners being substantially permanently attached to opposite ends of said band;

first and second lengths of compliant cord each permanently fixedly attached at one end to one end of said device, the other ends of said lengths of cord being unattached until the device is used, whereupon said band is positioned under the mattress, said cords are placed in folds adjacent marginal portions of the cover to be held onto the mattress on opposite sides of said mattress and said jaws of said fasteners are closed and locked over said folds and cords together with each fold enclosing one cord so that said cover is securely held thereby.

* * * * *